US006508155B1

(12) United States Patent
Phlipot

(10) Patent No.: US 6,508,155 B1
(45) Date of Patent: Jan. 21, 2003

(54) SELF-CENTERING TRIM PUNCH

(75) Inventor: Mark Phlipot, Minster, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 28 days.

(21) Appl. No.: 09/604,478

(22) Filed: Jun. 27, 2000

Related U.S. Application Data

(63) Continuation-in-part of application No. 09/340,220, filed on Jun. 25, 1999.

(51) Int. Cl.[7] ..... B26D 1/00
(52) U.S. Cl. ..... 83/684; 83/685
(58) Field of Search ..... 83/684, 685, 689

(56) References Cited

U.S. PATENT DOCUMENTS 2,374,436 A * 4/1945 Kennedy et al. ..... 83/139
2,379,003 A * 6/1945 Hedburg ..... 83/133
3,074,165 A * 1/1963 Davis ..... 30/358
3,086,411 A * 4/1963 De Lacey ..... 29/896.6
3,174,378 A * 3/1965 Friedland et al.
3,234,602 A * 2/1966 Hunter et al. ..... 164/212
3,621,534 A * 11/1971 De Troyer ..... 425/193
4,249,408 A 2/1981 Lovell ..... 72/256
4,916,931 A 4/1990 Kaeseler ..... 72/354
5,715,721 A 2/1998 Anders et al. ..... 72/311

* cited by examiner

*Primary Examiner*—M. Rachuba
(74) *Attorney, Agent, or Firm*—Alan T. McDonald; Vince Ciamacco; Standley & Gilcrest LLP

(57) ABSTRACT

Cast metal parts are created for use in making machinery. When these parts are formed, unwanted material remains in the openings of the parts. This material, called flash, must be removed. In the method of the present invention, the cast parts are placed on a platen of a trim press that has multi-part punches attached thereto that are configured to self-align with the openings in the cast part and operative to evenly remove the flash. The invention also relates to a punch that initially breaks through the flash with a stationary punch that removes a majority of the flash inside the opening of the cast part. Next, a moving or self-centering punch self-aligns to the opening in the cast part and operates to remove the remaining flash. The inventive punch may also include a mounting base for attachment of the multi-part punches to the plate or platen of the press.

13 Claims, 8 Drawing Sheets

SELF-CENTERING TRIM PUNCH

This is a continuation-in-part of application Ser. No. 09/340,220, filed Jun. 25, 1999.

TECHNICAL FIELD

This invention relates to a new method and tool for the trimming of flash from a cast part. The novel punch comprises a stationary element and a moving or self-centering element. The inventive punch initially removes a majority of the flash with the stationary element, then self-aligns to the center of the opening in the cast part, and thereafter removes the remaining flash to create a cast part that is free of flash and ready for the next machining step.

BACKGROUND OF THE INVENTION

In the metal fabrication industry, especially the automotive industry, it is necessary to achieve high dimensional precision when fabricating metal parts. For example, die cast metal parts are made for engines by forcing molten metal into a water-cooled steel mold. During cooling, the metal will "flash" between the two mold halves due to the high pressure used in the process. This flash must be trimmed off before the part is subjected to finish machining or attached to the final product and shipped to the customers.

Flash on a cast metal part is usually trimmed by the use of a device known as a trim press. A trim press consists of punches and die cores that work to remove the flash. The punches remove flash from openings in the cast metal part, while the die cores are adapted to create high precision surfaces on the casting. The cast part is placed in the trim press and then the press descends vertically with a momentum sufficient to shear and remove the flash with a punch. The traditional punch accomplishes this by self-aligning with the opening, by moving laterally relative to its vertical axis, and the press plate upon which it is mounted. A small amount of lateral movement is required to prevent damage to the cast part while flash is being removed so that certain tolerances can be maintained in desired dimensions of the cast part. After being cycled through the trim press, the part is inspected. The part will be rejected if too much flash remains. Depending on the particular application, most of the flash must be removed to meet predetermined tolerances. Typically, the parts are then fitted into final assemblies or machining jigs or pallets for further processing. Thus, in certain manufacturing environments, a part can be rejected if there is more than, for example, about 0.5 millimeters (mm) of flash encircling the inside of the opening in the cast part, or if the remaining flash is uneven, because the part will not fit on a machining pallet.

In removing the flash from cast parts, it is necessary to avoid damage to the part. In particular, damage can occur when removing flash from openings in the cast part. Such damage can occur as the cutting edge of a trim punch is moved into the opening for shearing and removal of the flash. Generally, the damage occurs from contact of the trim punch cutting edge with the cast part, or the sides of the opening, or both.

This damage may occur in several situations. When the maximum outside dimensions of the trim punch cutting edge exceeds the minimum possible dimensions of the cast part opening, the punch will contact and damage the part. Damage can also occur when the positional location of the cast part opening is slightly offset. In this instance, the trim punch will not be centered upon the opening.

In any of these situations, the trim punch cutting edge can be forced into undesired contact with the cast part. To avoid these problems, it is known to select-a trim punch cutting edge having maximum possible dimensions that are always less than the minimum possible dimensions of the opening in a cast part. It is also known to select a trim punch that can move horizontally relative to the centerline of the opening so as to align the trim punch with the cast part opening during the trimming operation. See, for example, U.S. Pat. No. 5,715,721. However, each of these methods requires an additional machining operation because all of the flash cannot be removed in a single fabrication step. Moreover, due to unavoidable manufacturing errors, such as the aforementioned opening oversize and undersize dimensions, positional tolerance stack-up and cast part opening misalignment, the flash will be removed unevenly relative to the centerline and the side walls of the cast part opening.

Previously, prior art devices have been directed to the low-precision initial removal of a large portion of the flash accompanied by subsequent additional high-precision manufacturing steps directed to the careful removal of the remaining flash to meet selected, acceptable tolerances. Accordingly, what is needed, but heretofore unavailable, is a trim punch that can evenly remove as much flash as possible without damaging the cast part and/or the opening in one step.

The vehicle industry is very competitive; and if the quality of cast parts is compromised, or if attaining the desired quality level is inefficient or unnecessarily expensive, the manufacturer suffers economically. The current system for removing flash from a die cast metal part is inadequate as an unacceptable high level of rejected parts is experienced. The self-centering trim punch of the present invention provides a solution to the problem of an excessive or uneven flash distribution on a metal casting. Dimensional tolerances of approximately 0.5 mm or less of flash remaining can be achieved using the inventive punch.

BACKGROUND ART

U.S. Pat. No. 5,715,721 to Anders et al. discloses an apparatus and method for forming flanges around multiple holes in a sheet metal part. This patent teaches dies and punches that are attached to holders that allow the dies and punches a small amount of lateral movement on their holders so that the punches may align with the holes in the part. The tools disclosed in this reference form multiple flanges in a piece of sheet metal by way of movement of the sheet metal part itself and also by small amounts of lateral movement of the punches and the dies. This reference does not suggest or disclose a punch that utilizes a moving or self-centering element in conjunction with a stationary element.

U.S. Pat. No. 4,916,931 to Kaeseler discloses a forming device containing a die, and inner and outer punches, which are used in the process of reforming used spot welding electrodes. The device according to the patent works by the forced vertical movement of a punch into a centering area of the die which, at the time of operation, has a deformed or used electrode placed on an inner die. The centering process for this apparatus is performed by the outer punch which surrounds the inner punch in a floating manner.

These references do not suggest nor disclose a method of using a self-centering punch to remove unwanted material (flash) from within a crevice, recess or opening formed in a casting. Further, the prior art punches do not employ an element that self-centers after a stationary punch initially removes a majority of the flash. In general, the prior art has used punches that have some freedom to move in an attempt to self-align. This lateral movement is enabled by the loose attachment of the punches to the trim press platen using a combination of machine screws and locating pins. This approach often results in damage to the part and the uneven or incomplete removal of flash. The multi-piece, self-centering punch, according to the present invention provides a solution to these problems and will produce a finished product that meets acceptable tolerances and that minimizes or eliminates flaws or deformations. The automotive industry needs an improved punch capable of meeting more demanding flash removal and tolerance specification in order to reduce the number of rejected parts and ensure the mandatory high quality and efficient production of the product. The inventive multi-piece, self-centering punch can meet these demands.

DISCLOSURE OF THE INVENTION

In general, the present invention relates to an improved punch and method for removing flash from cast parts. The inventive, multi-part, self-centering punch can reliably meet dimensional tolerance specifications requiring precision-exceeding standards of about 0.5 mm to minimize or eliminate the flash remaining inside a cast part opening. Thus, there is disclosed a self-aligning punch adapted for use in a press having upper and lower platens configured to remove flash from an opening in a cast part, said punch comprising:

a) a stationary punch formed with a through axial aperture and an attachment shaft configured to attach to a respective one of the upper and lower platens and a cutting surface;

b) a moving punch formed with an axial aperture and a tapered region that terminates with a cutting shoulder and wherein the axial aperture is adapted to receive the attachment shaft; and c) wherein the axial aperture and the height of the moving punch are dimensioned whereby the moving punch is horizontally and vertically moveable relative to at least one of said platens.

The punch according to the invention can be used to remove flash from all types of cast parts, including, for example, those made from molten and powdered metal or plastic materials. The presses that may employ the novel punch are those known in the art and are sometimes referred to as "trim presses." The press may be of conventional design such as a hydraulic press having a frame with a top cross member supporting several hydraulic cylinders in which hydraulic pistons are mounted for controlling vertical movement and exerting vertical force on a ram. The bottom face of the ram is a flat die or platen having a plate or block with attachment points for tooling and/or clamps. The bottom platen, which is typically immobile, is vertically aligned with the upper platen and is typically used to hold the cast part that is to have the flash removed.

Also disclosed is a method for removing flash from the inside of an opening of a cast part that includes the steps of:

a) placing the cast part on a platen of a press in a fixed position, the press comprising at least one multi-part punch comprising at least a moving punch and a stationary punch;

b) closing the press so that the stationary punch enters the opening of the cast part and removes a majority of the flash; and c) closing the press further to trim an additional portion of the remaining flash with the moving punch.

One important aspect of the present invention relates to the moving punch or self-centering element. This part of the punch removes flash left over by the stationary punch. The moving punch self-centers to the opening in the cast part and then, utilizing a cutting shoulder, removes the remaining flash. The trim press is then opened and the punches are retracted from the cast part. The part is removed from the platen and then it is inspected to see if enough flash has been removed so that the part meets the tolerances for the next machining step.

There is further disclosed an apparatus for removing flash from an opening in a casting, comprising:

a) a press;

b) a punch mounted on a platen of the press, the punch comprising a stationary punch formed to have a cutting surface and a shaft, and a moving punch that is configured with an axial aperture and a tapered region that is terminated by a cutting shoulder; and:

c) wherein the aperture and the height of the moving punch are dimensioned so that, upon the placement of the shaft of the stationary punch in the aperture, the moving punch is vertically and horizontally moveable relative to the platen of the press, and wherein the cutting surface of the stationary punch is operative, during flash removal, to initially remove a majority of the flash, whereafter the tapered region of the moving punch operates to align itself with the walls of the opening by moving horizontally and vertically and to remove at least a portion of the remaining flash as the cutting shoulder moves through the opening.

The invention also relates to a method for removing flash from an opening in a cast part that includes the steps of:

a) fixing said part on a first platen of a press;

b) attaching at least one punch to the second platen of said press, said punch comprising a stationary punch formed with a shaft and a cutting surface, and a moving punch formed with an axial aperture configured to receive the shaft and a tapered region that terminates at a cutting shoulder, wherein the aperture and the height of the moving punch are dimensioned so that the moving punch is moveable vertically and horizontally relative to the second platen;

c) closing the press whereby the cutting surface of the stationary punch removes a majority of the flash; and d) further closing the press whereby the tapered region of the moving punch contacts the walls of and aligns with the opening by moving horizontally and vertically and whereafter the cutting shoulder of the moving punch moves through the opening and removes at least a portion of the remaining flash.

BRIEF DESCRIPTION OF THE DRAWINGS

The invention and its many attendant objects and advantages will become better understood upon reading the following description of preferred embodiments in connection with the following drawings wherein.

BEST MODE FOR CARRYING OUT THE INVENTION

Figure 1:
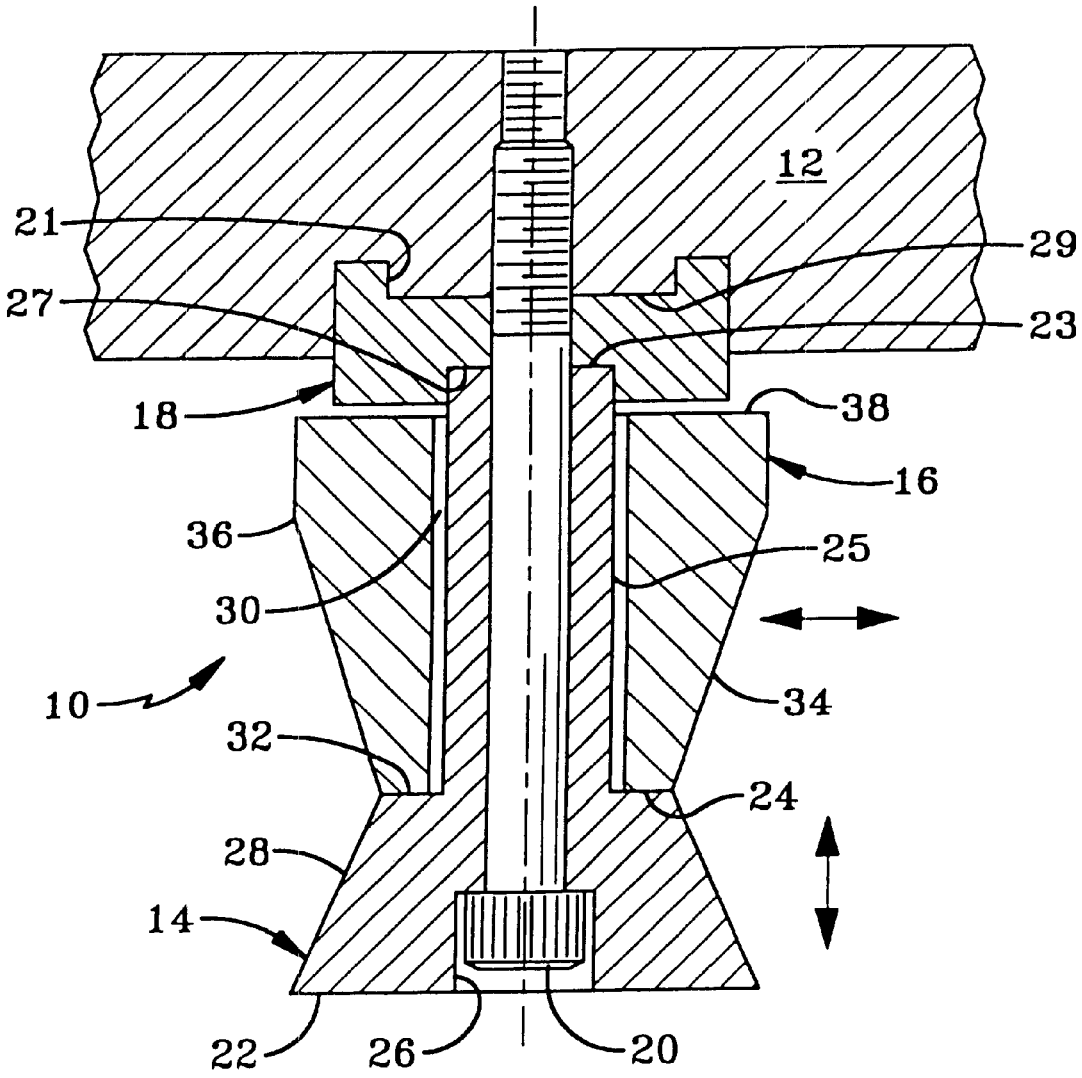
FIG. 1 is a cross-sectional view of the inventive punch showing the punch bolted to a platen or die of a press.

The punches displayed in the drawings, with the exception of FIG. 3, are preferred embodiments of the invention. Turning to the drawings, wherein like reference characters designate identical or corresponding parts, and more particularly to FIG. 1 wherein a multi-part, self-centering punch 10 is attached to an upper die plate or platen 12 of a press (not shown in FIG. 1). The punch 10 is configured to remove flash from a cast part with a high level of precision, reliability and accuracy. The punch 10 is typically located inferior to the upper platen 12, however, the punch 10 could be attached to a moveable or stationary lower platen of the press. The punch 10 incorporates a stationary punch 14 that is generally axially aligned and associated with the moving punch 16, and preferably attached to a mounting base 18. These parts 14, 16, and 18 are attached to the platen 12 by a bolt 20 or other fastening device. Other means of attaching the punch to the platen are contemplated herein, including releasable or fixed screws, press-fit pins, expandable bolts, threaded spindles and journals, lag and cap bolts, clamps and any of a host of similar fasteners. The stationary punch 14 and the mounting base 18 are preferably in a fixed relationship, while the moving punch 16 has freedom of movement, vertically and horizontally, relative to the stationary punch 14, the mounting base 18 and the platen 12. The freedom of movement can be accomplished in any of a number of equally suitable ways, as shown in the various figures herein and as further described in more detail below.

The stationary punch 14 portion of the inventive multi-part punch 10 is shown with a cutting base 22, that is generally circular in this embodiment. This embodiment is well suited for the removal of flash from a circular opening in a cast part. It should be noted, however, that the inventive punch can be used for square, oval, and other variously shaped openings. The stationary punch 14 is also formed to have a shoulder 24, a shaft 25, a tapered portion 28, and a top surface 27. The stationary punch 14 is also configured with a cavity or aperture 26 running generally axially through the center of the stationary punch 14 and the shaft 25. The cavity 26 includes a counter-bore proximate to the cutting base 22 and continues through shaft 25 to the top surface 27 so that the bolt 20 may protrude beyond the top surface 27 of the stationary punch 14 to engage and attach to the platen 12. The tapered portion 28 of the stationary punch 14 extends upward from the cutting base 22 to the generally horizontal region or shoulder 24. The shaft 25 of the stationary punch 14, depends upwardly from the shoulder 24 and continues until it adjoins the mounting base 18 at recess 23. (See FIG. 1.)

Figure 9:
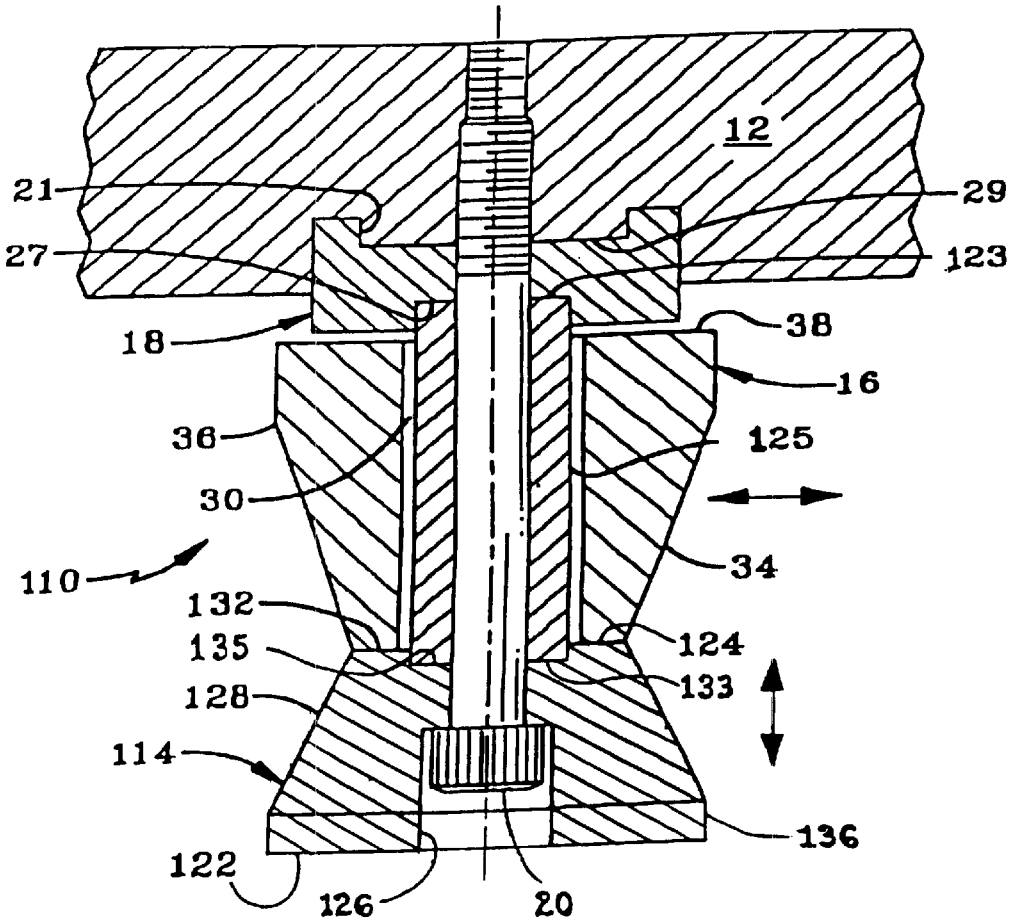
FIG. 9 is a cross-sectional view illustrating an alternate embodiment of the stationary punch portion of the self-centering trim punch.

An alternate embodiment of a self-centering punch 110 is shown in FIG. 9. This embodiment of the self-centering punch 110 is similar to the self-centering punch 10 of FIG. 1, but consists of a two-piece stationary punch 114. More specifically, the two-piece stationary punch 114 of FIG. 9 has a separate shaft 125 and tapered portion 128.

As discussed above in reference to the stationary punch 14 of FIG. 1, the tapered portion 28 of the stationary punch 14 may be forced into undesired contact with a cast part. In addition to damaging the cast part as a result of such undesired contact, portions of the stationary punch 14 may also be harmed. For example, if enough force is applied to the stationary punch 14 during an off-center hit, the shaft 25 may become bent. In addition, or alternatively, the undesired contact with the cast part may cause damage to at least a portion of the cutting base 22. Therefore, in those situations where only one of either the shaft or the tapered portion has been damaged due to undesired contact with the cast part, it is beneficial to be able to replace only that damaged portion.

The two-piece stationary punch 114 allows for such selective replacement. Like the shaft 25 of the stationary punch 14, a top end 123 of the shaft 125 of the two-piece stationary punch 114 is preferably designed to enter the recess 23 in the mounting base 18. An aperture passes axially through the shaft 125 along its center, and is provided for receiving a mounting bolt 20. The bottom end 133 of the shaft 125 is preferably designed to engage with a corresponding recess 135 in a shoulder 124 of the tapered portion 128.

The tapered portion 128 mates with the shaft 125 through the recess 135, thereby providing improved alignment of the sections of the two-piece stationary punch 114. An axially aligned aperture for receiving the bolt 20 exits through the shoulder 124 at one end of the tapered portion 128 and communicates with a counter-bore 126 which exits at the other end of the tapered portion. The counter-bore 126 allows the head of the bolt 20 to reside within the tapered portion 128. The cutting base 122 of the tapered portion 128 preferably extends downward to form a more substantial cutting edge 136, thereby improving the ability of the tapered portion to resist damage or breakage during undesired contact with the cast part.

Although in FIG. 9 the two-piece stationary punch 114 is shown to have a generally circular cutting base 122, it should be realized that the stationary punch could also be configured for use in square, oval, and other variously shaped openings. Additionally, it should be noted that while the two-piece stationary punch 114 is shown with an extended cutting base 122, it is also possible to utilize such a two-piece design with a cutting edge 22 as shown in FIG. 1.

The second component of the punch 10 is the moving punch 16. The moving punch 16 is configured to be vertically and horizontally moveable about the shaft 25 of the stationary punch 14. The moving punch 16 is free to move with three degrees of freedom about the shaft 25 subject to the upper boundary created by the mounting base 18. The moving punch 16 has an axial opening 30 through which the stationary punch shaft 25 passes. The axial opening or aperture 30 of the moving punch 16 is preferably from between approximately 5% to approximately 25%, and more preferably about 18%, larger in diameter than the diameter of the shaft 25. This allows for generally horizontal movement of the moving punch 16 in relation to the stationary punch 14 and the mounting base 18. The height of the moving punch 16, less the depth of the recess 23, is from between approximately 5% and approximately 30%, and most preferably about 20%, less than the height of the shaft 25. This allows for generally vertical movement of the moving punch 16 relative to the stationary punch 14 and the mounting base 18. This self-centering and aligning feature maximizes protection of the cast part from damage during the precision trimming operation by ensuring that the punch does not score the opening in the part when the press is activated. Further disclosure on the relative dimensions of the stationary punch and the moving punch are found below.

The base 32 of the moving punch 16, prior to entering the opening of the cast part (not shown in FIG. 1) rests upon the shoulder region 24 of the stationary punch 14. This base 32 adjoins the bottom of the tapered portion 34, which is responsible for the self-alignment or self-centering aspect of the inventive punch 10. Superior to the tapered portion 34 is the trimming portion or trimming shoulder 36. The shoulder 36 is configured to have a greater dimension than the cutting base 22 of the stationary punch 14. The selected shoulder dimension incorporates the desired tolerance precision so as to ensure that the proper amount of flash is removed. The height of the tapered portion 34 is between at least approximately 30% and approximately 70% of the total height of the moving punch 16, more preferably about 60%.

The top surface 38 of the moving punch 16 is a horizontal area which is directly inferior to the mounting base 18. The mounting base 18 may be omitted. However, customary tool and die practice commonly entails the use of a base to correctly position the punch and to protect the platen 12 from damage when the punch is in operation. The mounting base 18 is also configured with an axial opening for passage of the bolt 20, an engagement surface for the top surface 27 of the stationary punch 14, and a placement means 21 that is used in cooperation with the platen 12 to positionally locate the punch 10.

Figure 2:
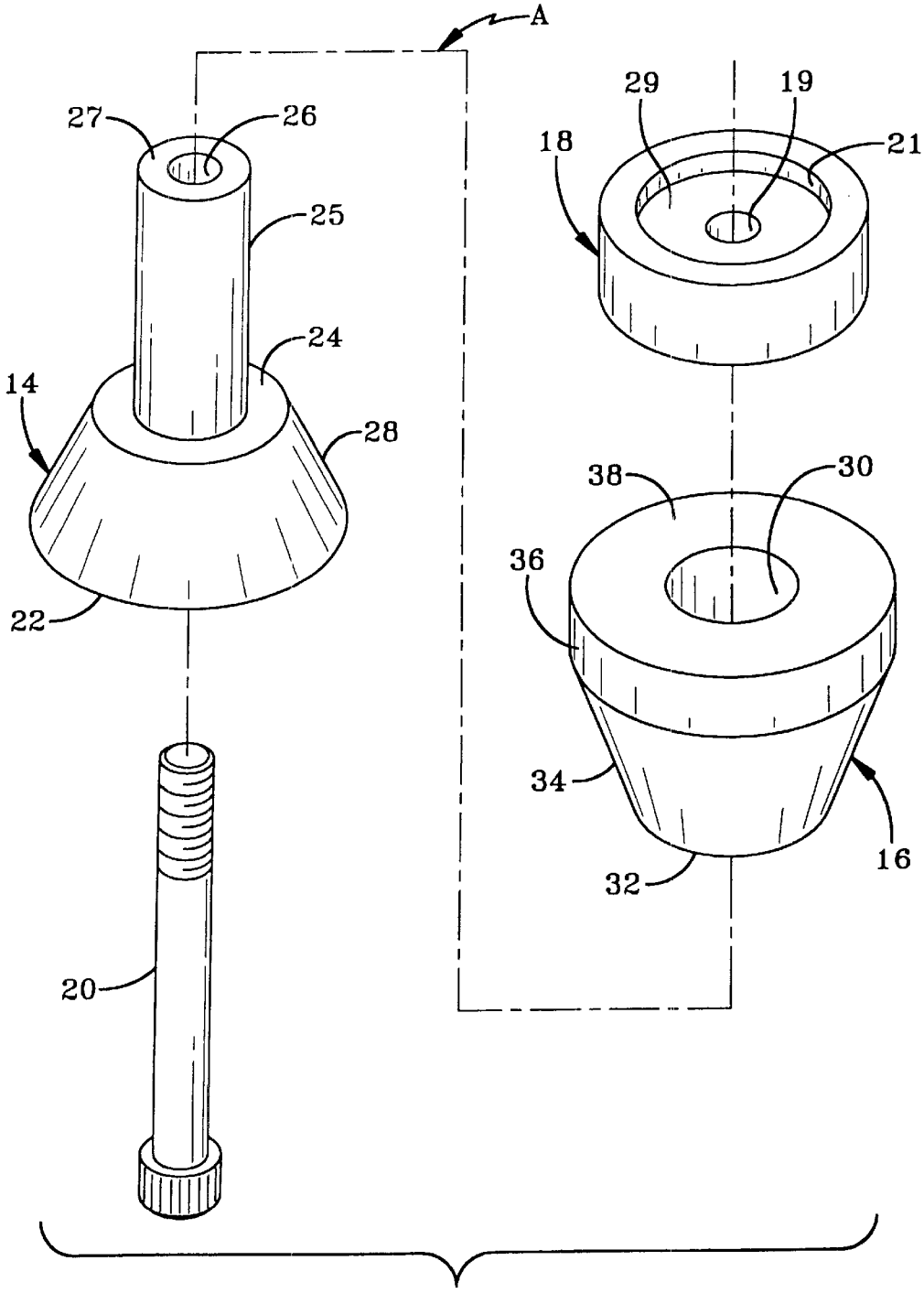
FIG. 2 is a perspective view of the self-centering trim punch of FIG. 1 in a disassembled configuration.

Turning now to FIG. 2, the construction and assembly of the punch 10 is explained. The bolt 20 extends vertically through the axial aperture 26 in the stationary punch 14. The bolt 20 also penetrates the opening 19 in the mounting base 18 along centerline "A" and thereafter enters into threaded engagement with the platen 12. (not shown in FIG. 2.) The moving punch 16 is placed over the shaft 25 of the stationary punch 14 before the bolt 20 engages the platen 12. After attachment of the punch to the platen and prior to closing the press, the moving punch 16 rests on the shoulder 24 of the stationary punch 14. It is important that a gap of preferably between approximately 5 and 20 mm exists between the top surface 38 and the adjacent surface of the mounting base 18 to assure that the moving punch 16 has acceptable vertical and horizontal ranges of motion.

Figure 3A:
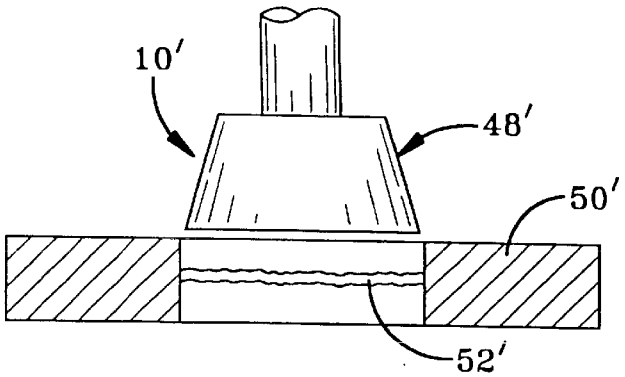
FIG-3A PRIOR ART
FIGS. 3A through 3D illustrate a prior art punch and its method of use in the removal of flash.
Figure 3B:
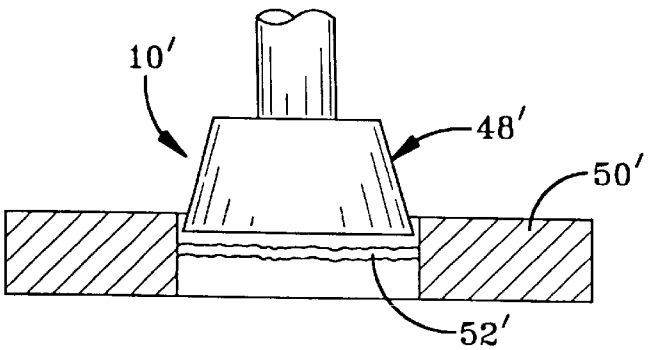
FIG-3B PRIOR ART
Figure 3C:
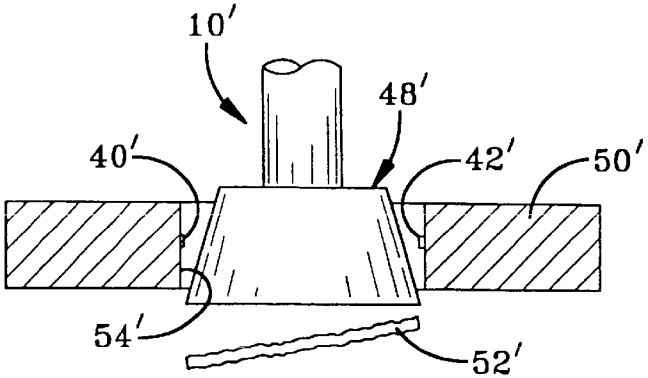
FIG-3C PRIOR ART
Figure 3D:
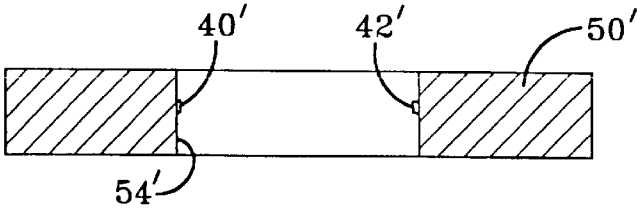
FIG-3D PRIOR ART

The drawings in FIGS. 3A through 3D illustrate the prior art punch 10' and its method of removing flash. FIG. 3A illustrates a single punch 48' in relation to a cast metal part 50' with flash 52'. FIG. 3B is the commencement of the punch through the cast metal part 50'. FIG. 3C illustrates the removal of flash 52' using the prior art single punch 48'. FIG. 3D is a view of the cast part 50' wherein 40' and 42' represent the flash remaining inside the opening of the part. Either, or both, remaining flash 40' and 42' will typically be greater than about 0.5 mm from the wall of the opening 54' in the cast part 50'.

In the past, it has been difficult to remove enough of the flash from the cast part in a single step because the cutting edge of the trim punch or dimensions of the cast part opening may be at the maximum allowable limits. This condition can cause damage to a cast part if, for example, the diameter of a cylindrical trim punch cutting edge exceeds the diameter of the cast part opening. In this example, an attempt to trim flash from the cast part will score the cast part opening as the cutting edge of the punch is pressed into the opening. Thus, the opening of the cast part will no longer be within specification. In addition to hole/punch oversize or undersize problems, positional tolerance dimensional stack-up can cause the centerline of the cutting edge of the trim punch to be out of line with the centerline of the cast part opening. In this situation, the cutting edge can damage the cast part opening. To overcome the former problem, the prior art devices often adapt a trim punch cutting edge that has a maximum outer diameter that is less than the minimum possible diameter of the cast part opening. To overcome the latter problem the prior art devices, such as that taught in U.S. Pat. No. 5,715,721 discussed above, have some freedom of lateral movement, but no vertical movement. However, neither of these approaches provide for removal of enough of the flash so as to minimize the need for additional machining operations. There is an obvious benefit to minimizing fabrication steps. If any portion of the remaining flash 40 and 42 exceeds about 0.5 mm or is uneven around the opening, the part cannot be accurately attached to a machining pallet. If the part cannot be accurately affixed to the machining pallet, it must be either rejected and returned for manual correction, or discarded. Both situations are unacceptable if efficiency is to be maintained and costs minimized.

Figure 4:
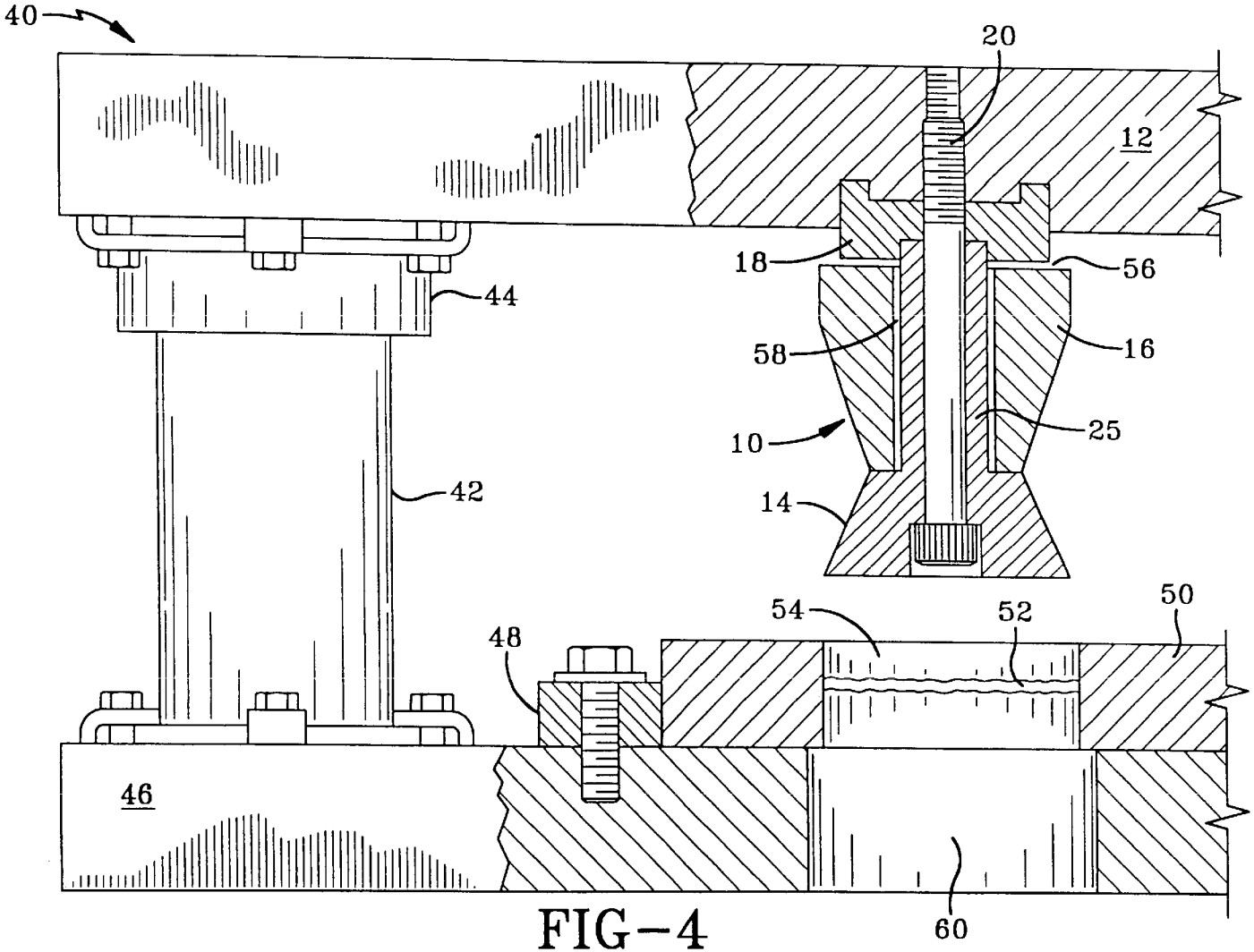
FIG. 4 is an elevation, partly in section, of a portion of the upper and lower platens of a press, and the inventive punch in relation to a portion of a cast part.

FIG. 4 illustrates a trim press 40 according to the present invention, specifically the region containing the guide posts 42, the guide bushings 44, and one inventive punch 10 as shown in FIG. 1. The attachment of the punch 10 to the upper platen 12 is accomplished with bolt 20. Guidepost 42 is mounted to the lower platen 46 of the press. When the trim press 40 is in motion, the guideposts 42 and guide bushings 44 work in conjunction to keep the two platens 12 and 46 aligned. The casting guide 48 holds the cast metal part 50 in a fixed position inferior to the punch 10. The cast metal part 50 has flash 52 present in the opening 54.

A gap 56 is present between the top surface 38 of the moving punch 16 and the lower surface of the mounting plate 18. This allows for single-axis, vertical movement of the moving punch 16. In similar fashion, a gap 58 exists between the shaft 25 of the stationary punch 14 and the axial opening 30 of the moving punch 16. This allows for two-axis, horizontal movement of the moving punch 16. An opening 60 in the lower platen 46 of the trim press 40 allows the flash 52 to fall from the cast metal part 50 and for the punch 10 to pass through the cast metal part 50.

In operation, the combination of three-axis, horizontal and vertical movement allows the moving punch 16 to center itself and align with the cast part opening 54 before the top surface of the moving punch 16 comes into contact with the lower surface of mounting plate 18. As the press lowers, contact between these surfaces will prevent any significant horizontal movement of the moving punch 16. By achieving alignment first, the cast part 50 and opening 54 will not be damaged during the flash removal operation.

Figure 5:
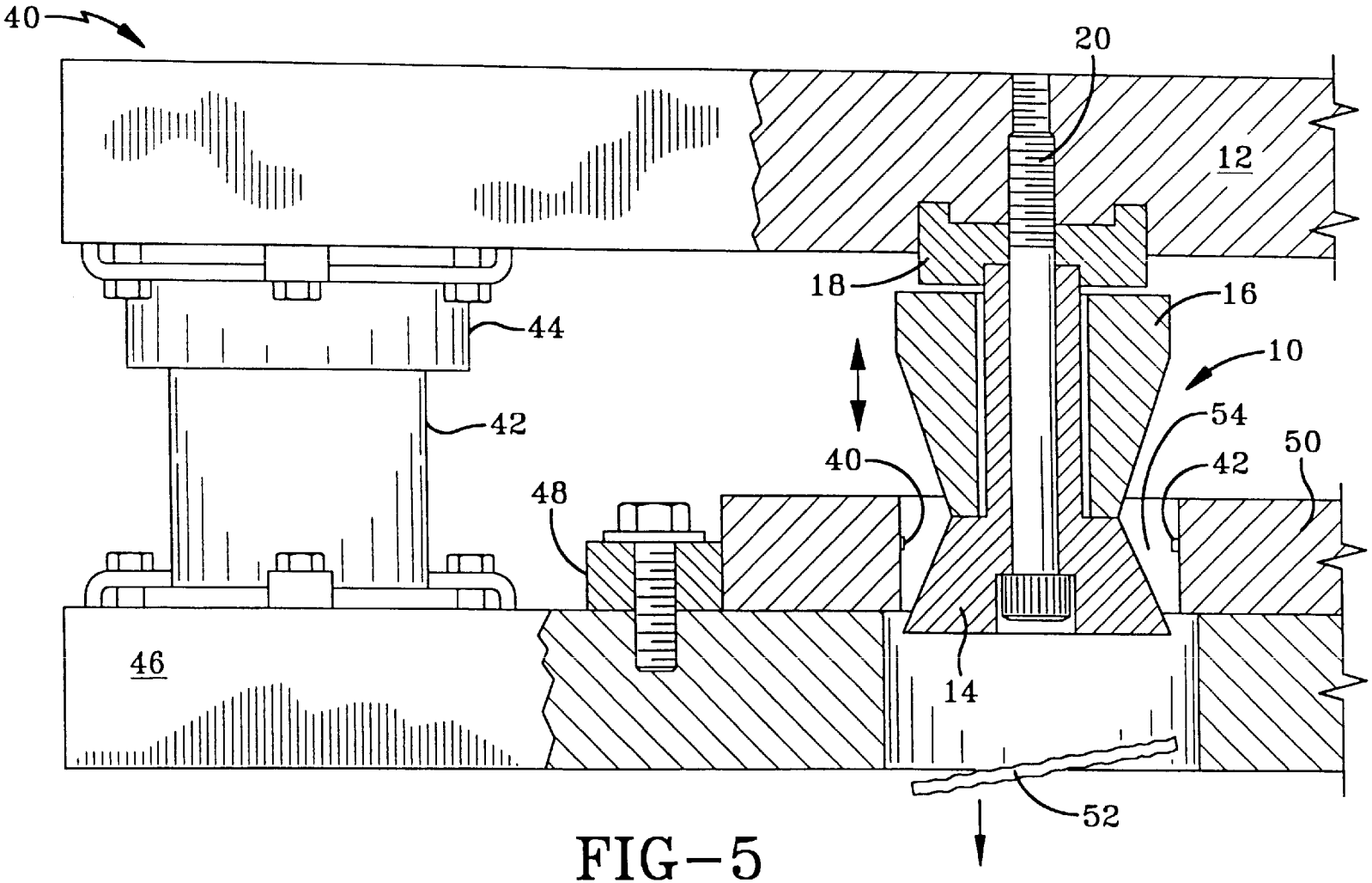
FIG. 5 depicts the press of FIG. 4 wherein the press has closed far enough to bring the stationary element of the punch into contact with the flash for partial removal. This illustrates a step in the removal of flash using the inventive punch.

FIG. 5 is the same as in FIG. 4, except that this illustration is a depiction of the trim press 40 after closure of the press has begun. With the closure of the trim press 40, the distance between the upper 12 and lower 46 platens is reduced and thereby the punch 10 is pressed into the cast metal part opening 54 and the majority of the flash 52 is sheared and removed by the stationary punch 14. The sheared flash 52 is ejected through the opening 60 in the lower platen 46. As illustrated, a portion of the flash remains as tabs 40 and 42 that need to be removed. Often the flash remaining 40 and 42 is uneven around the inside of the cast part opening 54, because of the aforementioned diametrical dimensional tolerances and the positional location tolerance stack-up.

Figure 6:
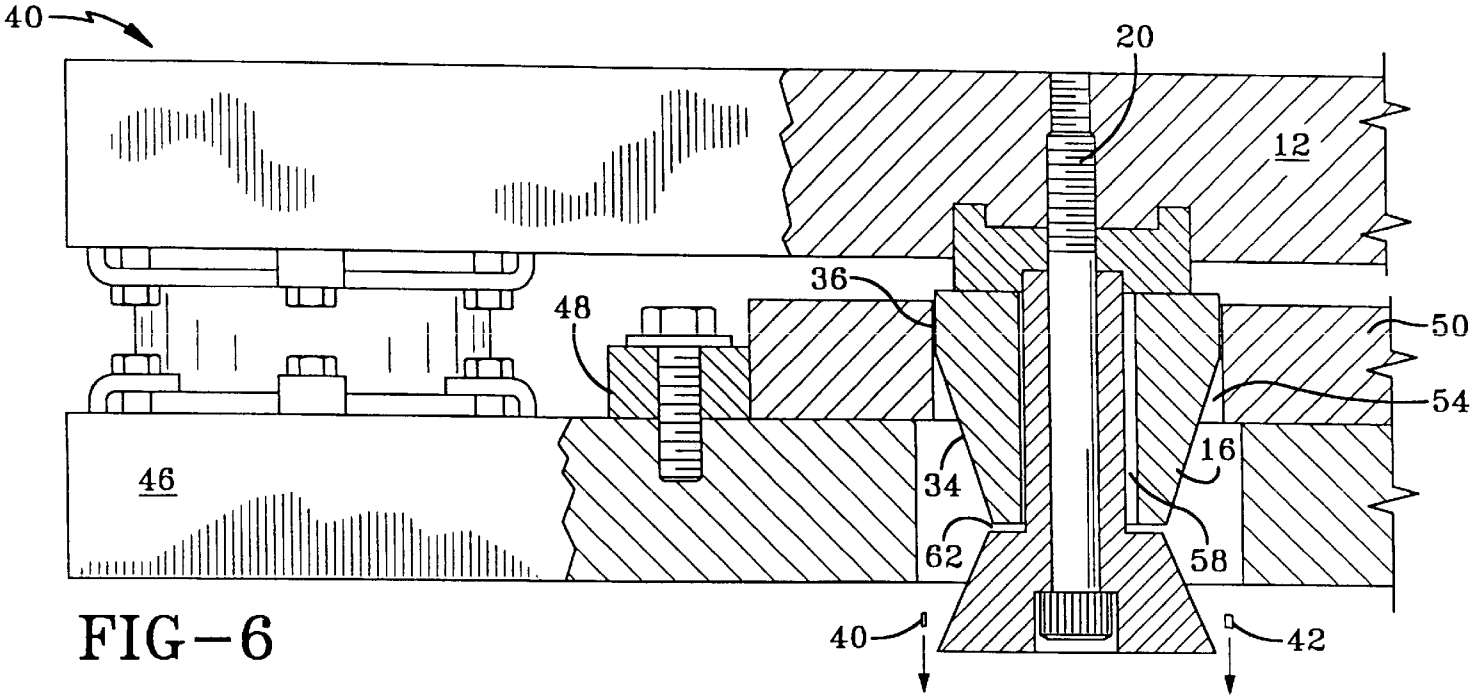
FIG. 6 depicts the press of FIGS. 4 and 5 wherein the press has completely closed, bringing the movable punch into contact with the flash for removal, completing the step of removing the flash.

FIG. 6 is the same area depicted in FIGS. 4 and 5, however the trim press 40 is almost completely closed. As illustrated, the moving punch 16 removes an additional portion of the remaining flash 40 and 42 from opening 54. This function is accomplished as the cutting shoulder 36 moves into opening 54 after the self-centering tapered portion 34 of the moving punch 16 aligns itself.

This movement of the moving punch 16 also provides for the even removal of some of the remaining flash 40 and 42 relative to the opening 54. As can be seen in FIG. 6, the gap 58 between the stationary punch shaft 25 and the moving punch 16, has increased as to one side so as to accomplish the proper positioning of the cutting shoulder 36 of the moving punch 16 relative to opening 54 of the cast part 50. The gap 56 (see FIG. 4) between the top surface 38 of the moving punch 16 and the lower surface of the mounting base 18 has closed and gap 62 is established between the moving punch 16 and the shoulder 24 of the stationary punch 14. Such movement ensures that the self-centering, tapered portion 34 of the moving punch 16 self-aligns with the opening in the cast metal part 54. The cutting shoulder 36 can then evenly trim the remaining flash 40, 42 to within acceptable tolerance limits without any damage to part 50 and opening 54.

Figure 7:
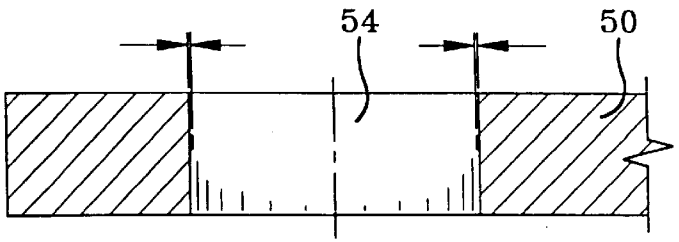
FIG. 7 is a cross-sectional view of the cast metal part of FIGS. 4, 5 and 6 after application of the inventive punch showing measurements of the remaining flash.

With reference to FIG. 7, a cross-sectional view of the cast metal part 50 is depicted in FIGS. 4, 5, and 6. It can be appreciated from the dimension symbols that the amount of the remaining flash has been reduced to the acceptable maximum tolerance, for example from 0.05 mm to about 0.5 mm.

Figure 8:
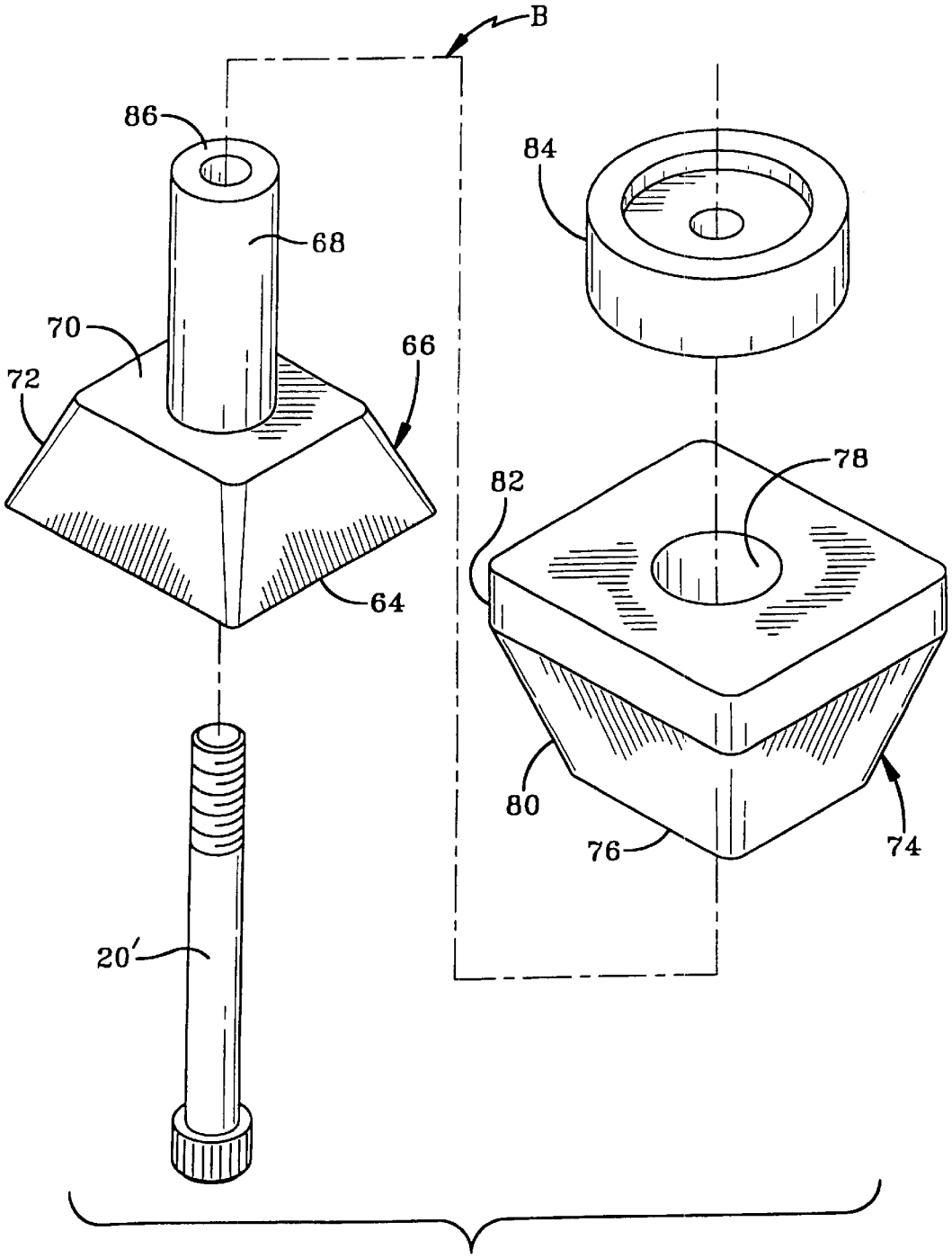
FIG. 8 is a perspective view of another embodiment of a punch according to the invention.

The final illustration, FIG. 8, is an additional embodiment of the invention wherein the stationary punch and the moving punch have a generally square shape with tapered and trapezoidal sides. Although square and circular trim punches are disclosed, the invention is equally suitable for any number of shapes, profiles and designs. This embodiment utilizes the concepts of the circular embodiment described above. The construction of this embodiment is illustrated as follows. The bolt 20' passes through the cutting base 64 of the stationary punch 66 and extends vertically through the aperture 86 of the shaft 68. The flat horizontal surface 70 is at the top of the tapered edges 72 of the stationary punch 66. With reference to centerline "B", it can be understood that the moving punch 74 is placed over the shaft 68 to rest upon this horizontally flat area 70. The base of the moving punch 76 is directly superior to the flat horizontal surface 70 of the stationary punch. The shaft of the stationary punch 68 extends vertically through the axial aperture 78 in the moving punch 74. The tapered edges 80 rise from the base 76 and lead to a cutting shoulder 82. The mounting base 84 rests between the top surface 86 of the shaft 68 and the upper press platen or die (not shown).

Those skilled in the art will appreciate that the inventive punch can be used individually or in groups of 2, 3, or more punches, depending upon the number of openings in the cast part that are in need of flash removal. The inventive punch may also be used in conjunction with other tools that are utilized in the press including, for example, forming dies, coring tools and boring devices.

As disclosed above, the relative dimensions of certain elements of the punches in accordance with the invention and the opening of the cast part, are important for the proper functioning of the punch. For example, with reference to FIGS. 1 through 7, if the opening 54 of the cast part 50 is circular and preferably has a diameter of approximately 73 mm, the diameter of the cutting base 22 of the stationary punch 14 preferably should range from between 67 mm and about 71 mm. Alternatively, for example, the diameter of the cutting base 22 should preferably be from about 90% to about 98% of the diameter of the opening 54. The diameter of the cutting shoulder 36 of the moving punch 16 may preferably range from about 71.5 mm to about 72.5 mm, most preferably about 72 mm. Alternatively, and again depending upon the desired manufacturing tolerances, the diameter of the cutting shoulder 36 should be from about 98% to about 99.9% of the diameter of the opening 54, more preferably from about 99% and 99.9%. The height of the tapered portion 34 of the moving punch 16 can vary widely depending upon the diameter and the depth of the part opening 54. However, the height of the tapered portion 34 should preferably be at least 30% of the total height of the moving punch 16, more preferably at least 40%, and most preferably at least 60%.

EXAMPLE

A punch, as described in the preferred embodiment, was built to the specifications listed below and the invention was used in a trim press for the removal of flash from a cast metal part. The cast metal part used in this Example was an automotive transmission housing that had three (3) circular openings in the part, each having a diameter of about 58 mm, from which flash was to be removed. The inventive punch was compared to the prior art punch and method illustrated in FIG. 3.

The stationary punch 14 had a cutting base 22 diameter of about 55 mm, a shaft height of about 60 mm, a tapered portion of about 20 mm in height, and shaft diameter of about 23 mm. The aperture 26 in the stationary punch 14 for the bolt 20 was about 11 mm in diameter, except for a recess for the bolt head which was about 19 mm in diameter. The shoulder region of the stationary punch 14 was about 40 mm in diameter and the total height of the stationary punch 14 was about 80 mm.

The diameter of the base 32 of the moving punch 16 was about 40 mm and the axial opening 30 had a diameter of about 27 mm through which the shaft 25 of the stationary punch 14 passes. The cutting shoulder 36 of the moving punch 16 was about 15 mm in height and about 57 mm in diameter. The tapered portion 34 starts with a minor diameter of about 40 mm and ends with a major diameter of about 57 mm in a distance of about 30 mm.

The mounting base 18 was generally a cylinder of about 55 mm in diameter and about 20 mm in height. However, a variety of shapes are equally suitable. In the approximately 55 mm diameter base 18 was a recess of about 23.2 mm in diameter and about 5 mm in height that accommodates the top 27 of the shaft 25 of the stationary punch 14. Through this recess 23 was an axial opening 13 which was about 11 mm in diameter and about 10 mm in height for passage of the bolt 20. Superior to this axial opening 19 was another recess 29 which was about 40 mm in diameter and about 5 mm in height for engagement with the top platen 12 of the press 40.

The inventive punch 10 was used in a trim.press to remove flash from 66,988 cast aluminum alloy parts. Of these 66,988 parts, none of them required repair or manual remachining due to faulty or inadequate flash removal. In contrast, the prior art punch 10 (FIGS. 3A through 3C) was used in the same process of removing flash and 81,669 cast metal parts were passed through the trim press. The number of cast metal parts that needed to be repaired was 9,648. These figures show that about 1 out of every 9 parts had to be repaired or replaced when using the prior art punch, all at a significant resource cost to the manufacturer. This data evidences the advance established by the inventive punch to the art of metal fabrication.

Industrial Applicability

The removal of flash from cast parts has changed little over the last few decades. Trim presses have been designed and fitted with punches that remove flash from openings in the cast part. However, the prior art punches have not been able to adjust to minor misalignment of the punch and part. This inability of the prior art punches to move, often creates a problem, in that, the flash is not completely and/or evenly removed. Incomplete and/or uneven removal of flash from the part causes problems in the next machining step or requires the manual removal of the interfering flash by one or more additional manufacturing operations subsequent to the flash trim operation.

The metal fabrication industry, especially the automotive industry, is constantly searching for improved manufacturing techniques. As set forth above, the multi-part punch according to the invention can effectively and efficiently remove flash to within acceptable tolerances from a cast part without creating defects or rejects. The inventive punch attains its improved performance in a single step, wherein a stationary punch removes most of the flash and a movable portion self adjusts to the opening in the cast metal part and then removes the residual flash.

Obviously, numerous modifications and variations of the preferred embodiments disclosed herein will occur to those skilled in the art. Accordingly, it is to be understood that the practice of these modifications and variations and the equivalents thereof, would be within the spirit and scope of the invention as defined in the following claims.

I claim:

1. A self-aligning punch adapted for mounting in a press having opposing platens and configured to remove flash from an opening in a cast part, the punch comprising:

a) a first punch, the first punch further comprising:
- an attachment shaft having an axial aperture and configured to attach to a first of the opposing platens; and
- a separate cutting portion;
- wherein the attachment shaft and the cutting portion are in releasable communication; and
- wherein the first punch moves axially with the first platen but is constrained against axial and transverse movement with respect to the first platen after attachment thereto;

b) a second punch formed with an axial aperture and a tapered portion that terminates with a cutting shoulder and wherein the axial aperture is adapted to receive the attachment shaft in a manner that permits axial and transverse movement of the second punch with respect to the first punch.

2. The punch according to claim 1 wherein the cutting portion of the first punch is adapted to releasably receive a portion of the attachment shaft.

3. The punch according to claim 1 wherein the cutting portion of the first punch has a cutting edge of some height for removing flash from the opening in the cast part.

4. The punch according to claim 1 wherein the cutting shoulder of the second punch is dimensioned to remove a maximum of between approximately 0.05 millimeters and approximately 0.50 millimeters of the remaining flash.

5. The punch according to claim 1 wherein the height of the tapered portion is between at least approximately 30 percent and approximately 70 percent of the total height of the moving punch.

6. The punch according to claim 1 wherein the height of the tapered portion is at least approximately 60 percent of the total height of the second punch.

7. The punch according to claim 1 wherein the maximum outer dimension of the cutting shoulder is between at least approximately 98 percent and approximately 99.9 percent of the minimum inner diameter of the opening of the cast part.

8. The punch according to claim 1 wherein the maximum outer dimension of the cutting shoulder is between at least approximately 99 percent and approximately 99.9 percent of the minimum inner dimension of the cast part opening.

9. The punch according to claim 1 wherein the second punch is moveably mounted on the first punch attachment shaft and wherein a gap exists between the exterior lateral dimension of the first punch shaft and the axial aperture of the second punch, the gap being operative to accommodate vertical and horizontal movement of the second punch so that it may self-align with the opening in the cast part.

10. The punch according to claim 9 wherein the minimum inner dimension of the axial aperture is between approximately 5 percent and approximately 25 percent greater than the maximum outer dimension of the first punch attachment shaft.

11. The punch according to claim 9 wherein the minimum inner dimension of the axial aperture is about 18 percent greater than the maximum outer dimension of the first punch attachment shaft.

12. The punch according to claim 9 wherein the gap is between at least approximately 5 millimeters and approximately 20 millimeters.

13. The punch of claim 1 wherein either of the attachment shaft or cutting portion of the first punch may be replaced, independent of replacement of the other.

* * * * *